US010486863B2

(12) United States Patent
Lee

(10) Patent No.: US 10,486,863 B2
(45) Date of Patent: Nov. 26, 2019

(54) BAG KNOT STRUCTURE

(71) Applicant: Minwoo Lee, Suwon-si (KR)

(72) Inventor: Minwoo Lee, Suwon-si (KR)

( * ) Notice: Subject to any disclaimer, the term of this patent is extended or adjusted under 35 U.S.C. 154(b) by 0 days.

(21) Appl. No.: 16/097,314

(22) PCT Filed: Jul. 22, 2016

(86) PCT No.: PCT/KR2016/008001
§ 371 (c)(1),
(2) Date: Oct. 29, 2018

(87) PCT Pub. No.: WO2017/209348
PCT Pub. Date: Dec. 7, 2017

(65) Prior Publication Data

US 2019/0135497 A1 May 9, 2019

(30) Foreign Application Priority Data

Jun. 2, 2016 (KR) ..... 10-2016-0068571

(51) Int. Cl.
*B65D 33/00* (2006.01)
*B65D 33/28* (2006.01)
*B65D 85/808* (2006.01)
*B65D 85/34* (2006.01)

(52) U.S. Cl.
CPC ..... *B65D 33/28* (2013.01); *B65D 85/345* (2013.01); *B65D 85/808* (2013.01)

(58) Field of Classification Search
CPC ..... B65D 33/28; B65D 85/345; B65D 85/808
USPC ..... 383/76
See application file for complete search history.

(56) References Cited

U.S. PATENT DOCUMENTS 467,108 A * 1/1892 Cussen ..... B65D 33/28 383/75
3,721,383 A * 3/1973 Dufes ..... B65D 33/16 383/203
3,752,388 A * 8/1973 Lynch ..... B65D 33/28 383/7
3,920,180 A * 11/1975 Meier ..... B61D 47/00 383/75
4,445,230 A * 4/1984 Spadaro ..... B65D 33/1608 383/26

(Continued)

FOREIGN PATENT DOCUMENTS

EP 1273529 A1 1/2003
GB 197725 A 5/1923

(Continued)

*Primary Examiner* — Peter N Helvey
(74) *Attorney, Agent, or Firm* — KORUS Patent, LLC; Seong Il Jeong

(57) ABSTRACT

Provided is a bag knot structure including: a bag body part (10) formed in two layers, and configured to have closed three sides and have an open inlet; a first hole (21) located on one side of the top of the bag body part (10) and in proximity to the inlet, and formed through the bag body part (10); a second hole (22) located in proximity to the first hole (21), and formed through the bag body part (10); a third hole (23) spaced apart from the second hole (22), located on the other side of the top, and formed through the bag body part (10); and a knotting wire (30) disposed on the back surface of the bag body part (10); wherein parts of the knotting wire (30) are caused to form a first loop (31), a second loop (32), and a grip (34).

1 Claim, 4 Drawing Sheets

(56) References Cited

U.S. PATENT DOCUMENTS

| | | | | | |
|---|---|---|---|---|---|
| 5,160,196 | A * | 11/1992 | Curtis | B65D 33/007 | |
| | | | | 383/33 | |
| 6,059,458 | A * | 5/2000 | Belias | B65D 33/28 | |
| | | | | 220/495.11 | |
| 2004/0071830 | A1 | 4/2004 | Klar | | |
| 2004/0252921 | A1 | 12/2004 | Winiarski et al. | | |

FOREIGN PATENT DOCUMENTS

| | | | |
|---|---|---|---|
| JP | 2013-158268 | A | 8/2013 |
| KR | 20-1999-0033842 | U | 8/1999 |
| KR | 10-2000-0018055 | A | 4/2000 |
| KR | 20-0299304 | Y1 | 12/2002 |
| KR | 20-0394540 | Y1 | 9/2005 |

* cited by examiner

BAG KNOT STRUCTURE

TECHNICAL FIELD

The present invention relates to a bag knot structure.

BACKGROUND ART

In order to extract and drink tea or coffee, a tea or coffee material is packaged with a bag (a tea bag). Such a bag may be made of a nonwoven or cotton fabric material through which tea or coffee contained therein cannot be moved to the outside and through which water can be passed.

Such a bag is made of two layers of fabric, three sides of the bag are closed, and a top inlet is formed in the bag. It is necessary to open the inlet of the bag, to put a tea or coffee material into the bag, and to close the inlet of the bag. In this case, there is a need for a method of conveniently closing the inlet of the bag.

Meanwhile, a bag may surround a fruit, such as a pear, and may protect it from insects. In this case, in order to facilitate work, it is necessary to easily tie the bag, surrounding the pear, by means of a one-touch method.

DISCLOSURE

Technical Problem

The present invention is intended to provide a bag knot structure that can tie the inlet of a bag with one touch.

Technical Solution

According to an aspect of the present invention, there is provided a bag knot structure including:

a bag body part (10) formed in two layers, and configured to have closed three sides and have an open inlet at the top thereof;

a first hole (21) located on one side of the top of the bag body part (10) and in proximity to the inlet, and formed through the bag body part (10);

a second hole (22) located in proximity to the first hole (21), and formed through the bag body part (10);

a third hole (23) spaced apart from the second hole (22), located on the other side of the top of the bag body part (10), and formed through the bag body part (10); and a knotting wire (30) disposed on the back surface of the bag body part (10);

wherein part of the knotting wire (30) is passed through the first hole (21) from the back surface of the bag body part (10), is moved to the front surface of the bag body part (10), and is caused to form a first loop (31);

wherein part of the knotting wire (30) is passed through the second hole (22) from the back surface of the bag body part (10), is moved to the front surface, is passed through the first loop (31), and is caused to form a second loop (32); and wherein part of the knotting wire (30) is passed through the third hole (23) from the back surface of the bag body part (10), is moved to the front surface, and is caused to form a grip (34).

Advantageous Effects

The present invention is intended to provide the bag knot structure that can tie the inlet of a bag with one touch.

BEST MODE

Figure 1:
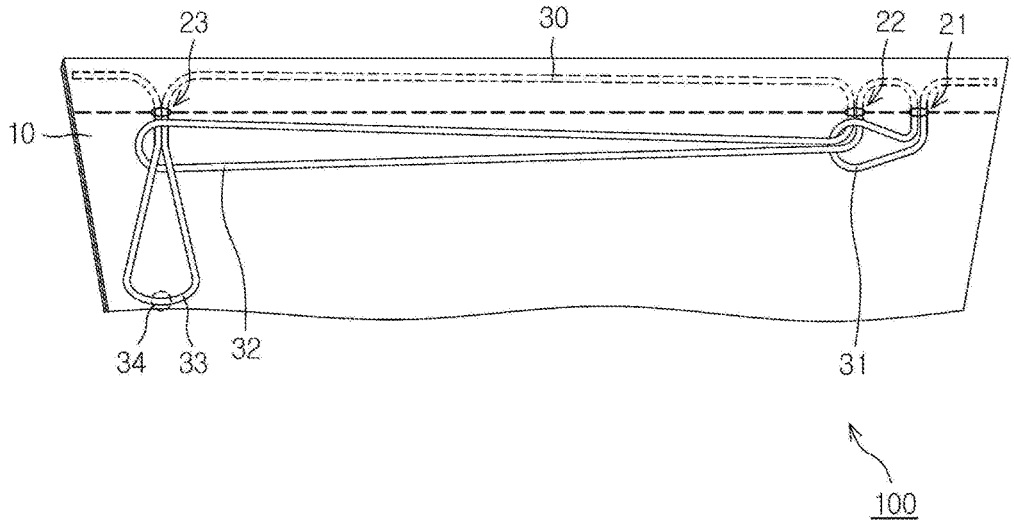
FIG. 1 is a front view of a bag knot structure according to an embodiment of the present invention.

There is provided a bag knot structure including:

a bag body part 10 formed in two layers, and configured to have closed three sides and have an open inlet at the top thereof;

a first hole 21 located on one side of the top of the bag body part 10 and in proximity to the inlet, and formed through the bag body part 10;

a second hole 22 located in proximity to the first hole 21, and formed through the bag body part 10;

a third hole 23 spaced apart from the second hole 22, located on the other side of the top of the bag body part 10, and formed through the bag body part 10; and a knotting wire 30 disposed on the back surface of the bag body part 10;

wherein part of the knotting wire 30 is passed through the first hole 21 from the back surface of the bag body part 10, is moved to the front surface of the bag body part 10, and is caused to form a first loop 31;

wherein part of the knotting wire 30 is passed through the second hole 22 from the back surface of the bag body part 10, is moved to the front surface, is passed through the first loop 31, and is caused to form a second loop 32; and wherein part of the knotting wire 30 is passed through the third hole 23 from the back surface of the bag body part 10, is moved to the front surface, and is caused to form a grip 34.

MODE FOR INVENTION

A preferred embodiment of the present invention will be described in detail below with reference to the accompanying drawings. This is intended to describe the present invention in detail to such an extent that those having ordinary knowledge in the art to which the present invention pertains can easily practice the present invention, but the spirit and scope of the present invention are not limited by the above description.

Figure 2:
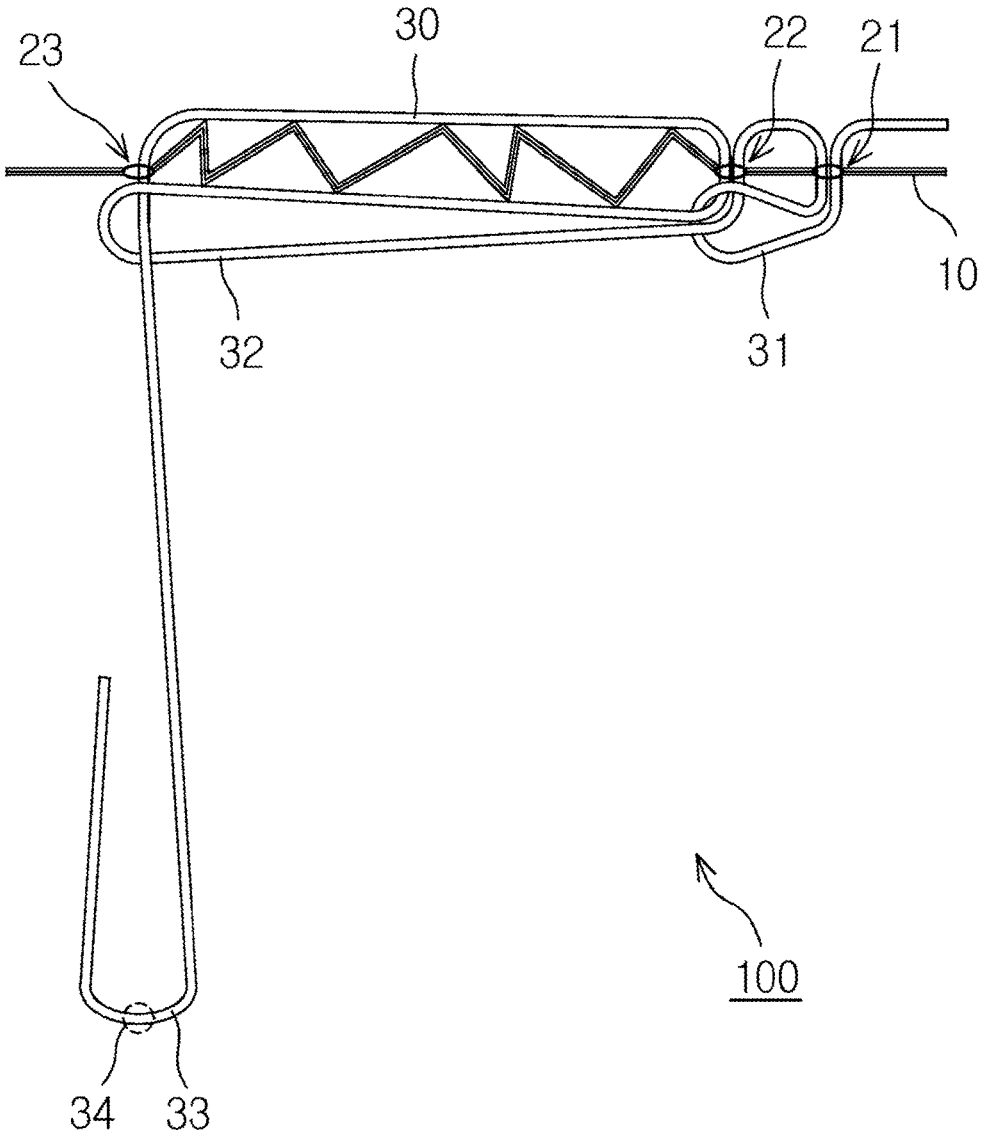
FIGS. 2 and 3 are views showing an example of the bag knot structure according to the embodiment of the present invention (plan views)
Figure 3:
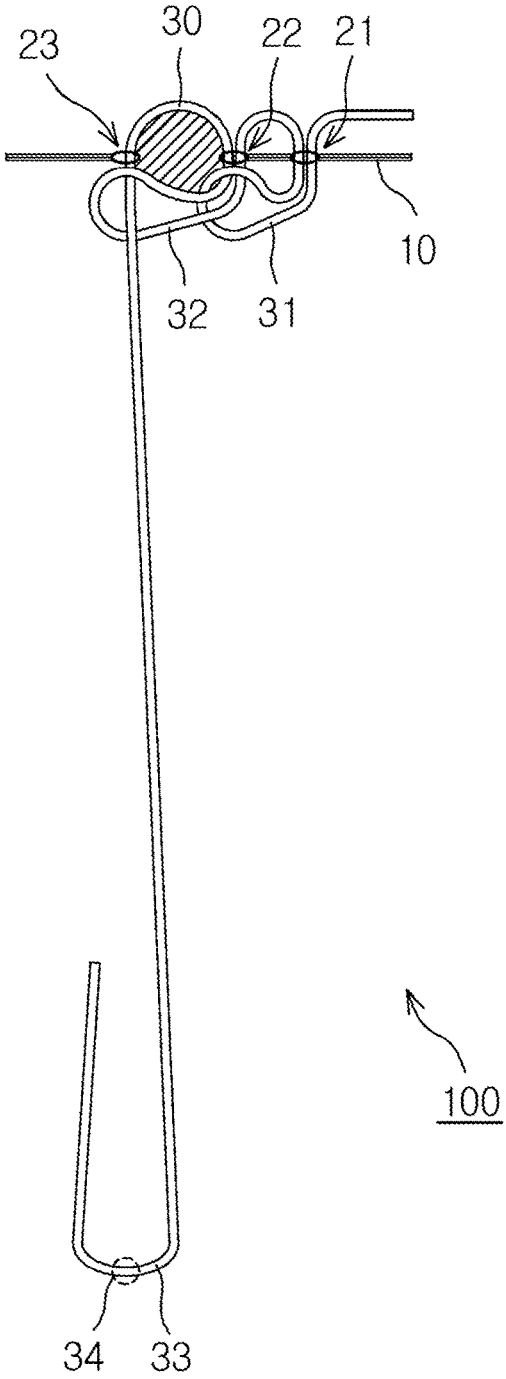
Figure 4:
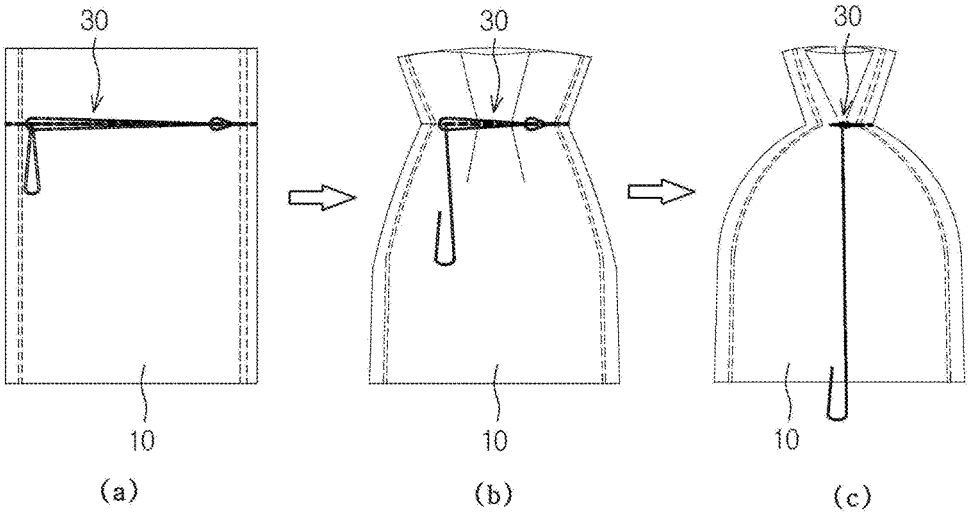
FIG. 4 is a view showing an example of the bag knot structure according to the embodiment of the present invention (a front view).

FIG. 1 is a front view of a bag knot structure according to an embodiment of the present invention, FIGS. 2 and 3 are views showing an example of the bag knot structure according to the embodiment of the present invention (plan views), and FIG. 4 is a view showing an example of the bag knot structure according to the embodiment of the present invention (a front view).

The bag knot structure 100 according to the present embodiment includes:

a bag body part 10 formed in two layers, and configured to have closed three sides and have an open inlet at the top thereof;

a first hole 21 located on one side of the top of the bag body part 10 and in proximity to the inlet, and formed through the bag body part;

a second hole 22 located in proximity to the first hole 21, and formed through the bag body part 10;

a third hole 23 spaced apart from the second hole 22, located on the other side of the top of the bag body part 10, and formed through the bag body part 10; and a knotting wire 30 disposed on the back surface of the bag body part 10;

wherein part of the knotting wire 30 is passed through the first hole 21 from the back surface of the bag body part 10, is moved to the front surface of the bag body part 10, and is caused to form a first loop 31;

wherein part of the knotting wire 30 is passed through the second hole 22 from the back surface of the bag body part 10, is moved to the front surface, is passed through the first loop 31, and is caused to form a second loop 32; and wherein part of the knotting wire 30 is passed through the third hole 23 from the back surface of the bag body part 10, is moved to the front surface, and is caused to form a grip 34.

The bag body part 10 is formed in two layers, and the three sides of the bag body part 10 are closed. The inlet at the top of the bag body part 10 is open. The bag body part 10 may be made of a material, such as nonwoven fabric sheets, cotton fabrics, paper, or plastic films. Three sides of two layers of nonwoven fabric sheets are closed, and an inlet at the top of the two layers of nonwoven fabric sheets is open.

The first hole 21 is formed on one side of the top of the bag body part 10. The first hole 21 is located in proximity to the inlet of the bag body part 10, and is passed through the bag body part 10.

The second hole 22 is located in proximity to the first hole 21, and is formed through the bag body part 10.

The third hole 23 is spaced apart from the second hole 22, is located on the other side of the top of the bag body part 10, and is formed through the bag body part 10.

The knotting wire 30 is disposed on the back surface of the bag body part 10, and forms knots on the front surface of the bag body part 10. The knotting wire 30 is composed of a single string. When the grip 34 of the knotting wire 30 according to the present embodiment is pulled, the inlet of the bag body part 10 is fastened. In other words, the inlet of the bag body part 10 can be fastened with one touch.

The knot structure of the knotting wire 30 will be described in detail below.

Part of the knotting wire 30 is passed through the first hole 21 from the back surface of the bag body part 10, is moved to the front surface, and is caused to form a first loop 31. The knotting wire 30 is disposed on the back surface in an initial stage. When the knotting wire 30 is pulled forward through the first hole 21, the first loop 31 is formed.

When the knotting wire 30 disposed on the back surface of the bag body part 10 is pulled forward through the second hole 22, part of the knotting wire 30 is moved out of the second hole 22, and forms the second loop 32. Furthermore, the second loop 32 is passed through the first loop 31.

When the knotting wire 30 disposed on the back surface of the bag body part 10 is pulled forward through the third hole 33, the grip 34 is moved out of the third hole 33, and is passed through the second loop 32. The grip 34 may be caused to form the third loop 33.

As a result, a knot structure, such as that shown in FIG. 1, is formed on the inlet of the bag body part 10.

FIGS. 2 and 3 show a process in which the inlet of the bag body part 10 is fastened when the grip 34 is pulled. When the grip 34 of the knotting wire 30 is pulled, the loose portion of the knotting wire is tightened first. Since the interval between the second hole 22 and the third hole 23 is larger than that between the second hole 22 and the first hole 21, the portion of the knotting wire 30 between the second hole 22 and the third hole 23 is relatively loose. Accordingly, this portion of the knotting wire 30 is tightened. In particular, since the grip 34 in proximity to the third hole 23 is pulled, force tightens the portion of the knotting wire 30 in proximity to the third hole 23.

After the portion of the knotting wire 30 between the second hole 22 and the third hole 23 has been tightened, the portion of the knotting wire 30 between the first hole 21 and the second hole 22 is tightened. When the two portions have been tightened, the overall knot structure is securely tied. As a result, the inlet of the bag body part 10 is tied, and is thus closed. Consequently, a food material put into the bag body part 10 is prevented from being moved to the outside.

The bag according to the present embodiment may be tied after a food material, such as coffee or tea, has been put into the bag, or may be tied by pulling the knotting wire by means of a one-touch method after a fruit, such as a pear, has been covered with the bag. The bag may be used for various uses according to the selections of a user, as well as for the above uses.

While the embodiment of the present invention has been described in detail above, the embodiment is merely one embodiment, but the claims of the present invention are not limited by the embodiment. The range equivalent to the present embodiment, within which those skilled in the art make modifications and additions, should be viewed as falling within the range of the rights of the present invention.

INDUSTRIAL APPLICABILITY

The present invention can be utilized in the tea-related markets or the fruit packaging and industrial packaging-related industries.

The invention claimed is:

1. A bag knot structure comprising:

a bag body part (10) formed in two layers, and configured to have closed three sides and have an open inlet at the top thereof;

a first hole (21) located on one side of the top of the bag body part (10) and in proximity to the inlet, and formed through the bag body part (10);

a second hole (22) located in proximity to the first hole (21), and formed through the bag body part (10);

a third hole (23) spaced apart from the second hole (22), located on the other side of the top of the bag body part (10), and formed through the bag body part (10); and a knotting wire (30) disposed on the back surface of the bag body part (10);

wherein part of the knotting wire (30) is passed through the first hole (21) from the back surface of the bag body part (10), is moved to the front surface of the bag body part (10), and is caused to form a first loop (31);

wherein part of the knotting wire (30) is passed through the second hole (22) from the back surface of the bag body part (10), is moved to the front surface, is passed through the first loop (31), and is caused to form a second loop (32); and wherein part of the knotting wire (30) is passed through the third hole (23) from the back surface of the bag body part (10), is moved to the front surface, and is caused to form a grip (34).

* * * * *